United States Patent [19]

Webb et al.

[11] 4,009,589

[45] Mar. 1, 1977

[54] SINGLE EVAPORATOR, SINGLE FAN COMBINATION REFRIGERATOR WITH INDEPENDENT TEMPERATURE CONTROLS AND METHOD OF ADJUSTMENT

[75] Inventors: William M. Webb, Louisville, Ky.; Stephen G. Boughton, Antioch, Tenn.

[73] Assignee: General Electric Company, Louisville, Ky.

[22] Filed: Jan. 2, 1976

[21] Appl. No.: 646,166

[52] U.S. Cl. ..... 62/180; 62/187; 62/455

[51] Int. Cl.[2] ..... F25D 17/00

[58] Field of Search ..... 62/180, 187, 455

[56] References Cited

UNITED STATES PATENTS

| | | | |
|---|---|---|---|
| 2,863,300 | 12/1958 | Murphy et al. | 62/180 |
| 3,005,321 | 10/1961 | Devery | 62/186 |
| 3,126,717 | 3/1964 | Schumacher | 62/180 |
| 3,320,761 | 5/1967 | Gelbard | 62/180 |
| 3,793,847 | 2/1974 | Scarlett et al. | 62/190 |

*Primary Examiner*—William E. Wayner
*Assistant Examiner*—Robert J. Charvat
*Attorney, Agent, or Firm*—Steven C. Schnedler; Francis H. Boos

[57] ABSTRACT

A single evaporator, single fan combination refrigerator includes a temperature control system which thermostatically maintains the fresh food compartment at a desired temperature by cycling the refrigerator system on and off as required, and which controls freezer compartment temperature by varying airfow through a pair of ducts conducting refrigerated air from the evaporator chamber to the fresh food compartment. The freezer control operates a pair of main dampers disposed in the ducts. In order to compensate for variations in freezer compartment temperature which would otherwise result when the setting of the thermostatic fresh food control is changed, a pair of compensating dampers are also disposed in the ducts and operatively connected to the fresh food control for ganged operation with the thermostatic control. The dampers are constructed to only partially block airflow when in the fully closed position. In certain embodiments, selection of damper characteristics is easier than in other embodiments, and a method of selection is described.

3 Claims, 8 Drawing Figures

SINGLE EVAPORATOR, SINGLE FAN COMBINATION REFRIGERATOR WITH INDEPENDENT TEMPERATURE CONTROLS AND METHOD OF ADJUSTMENT

CROSS REFERENCE TO RELATED APPLICATION

The present invention is partly disclosed, but not claimed, in copending application Ser. No. 646,167, filed 1/02/76, concurrently herewith, by William M. Webb and William F. Hester, entitled SINGLE EVAPORATOR, SINGLE FAN COMBINATION REFRIGERATOR WITH INDEPENDENT TEMPERATURE CONTROLS, and assigned to the same assignee as the present invention.

BACKGROUND OF THE INVENTION

1. Field of the Invention

The present invention relates to household refrigerators and more particularly to a temperature control system for a single evaporator, single fan type combination refrigerator including independent freezer compartment and fresh food compartment temperature controls.

2. Description of the Prior Art

Combination refrigerators of the "frost free" type including a single evaporator and a single fan for circulating air from the freezer and the fresh food compartments over the evaporator are well known. Examples are disclosed in U.S. Pat. No. 3,126,177-Schumacher and in U.S. Pat. No. 3,320,761-Gelbard. In such refrigerators, a major portion (approximately 90%) of the refrigerated air from the evaporator is directed through a passageway into the freezer compartment while a smaller portion (approximately 10%) is directed through a duct into the fresh food compartment. Two user-operable temperature control members are provided. One control member is for setting a temperature to be maintained in the fresh food compartment and is typically called either the "fresh food control" or "cold control." The fresh food control dial has graduations from 1 through 9, 1 indicating the warmest temperature and 9 indicating the coldest temperature to be set. The other control member is primarily for determining a preset temperature to be maintained in the freezer compartment and is typically called the "freezer control." The freezer control has graduations from A through E, with E being the coldest position.

The fresh food control is operatively connected to a thermostatic control which senses either fresh food compartment air temperature or a mixture of compartment air and incoming refrigerated air from the evaporator and thermostatically maintains the fresh food compartment temperature near the desired temperature by periodically energizing and de-energizing the refrigeration compressor, and thus the evaporator, in a conventional manner. Usually, the fan is energized and de-energized along with the evaporator. The thermostatic control causes energization of the evaporator when the fresh food compartment temperature exceeds the temperature setting of the fresh food control and causes de-energization of the evaporator when the fresh food compartment temperature is less than the temperature setting of the fresh food control.

The freezer control is connected in simple fashion to an air flow damper positioned in the duct which carries refrigerated air from the evaporator chamber to the fresh food compartment. In operation, as the freezer control is moved toward E, or the coldest position, the damper is closed more, reducing the amount of refrigerated air flowing into the fresh food compartment. Since the temperature in the fresh food compartment is thermostatically controlled, the compressor, under control of the thermostatic control simply runs longer or more often to satisfy the requirements of the fresh food compartment. When the compressor and evaporator run more, more refrigerated air flows into the freezer compartment for a longer period of time and the freezer compartment gets colder. Conversely, as the freezer control is moved toward A, or the warmest position, the damper is opened more, allowing more refrigerated air from the evaporator chamber to flow through the duct into the fresh food compartment. This causes the compressor and the evaporator to be energized less frequently or for shorter periods of time to satisfy the cooling requirements of the fresh food compartment. Since the temperature in the freezer compartment is directly related to the percentage of compressor and evaporator "on" time, the temperature in the freezer compartment decreases.

To summarize the above, in prior art refrigerators the temperature in the fresh food compartment is thermostatically controlled by energizing the compressor and evaporator in response to the cooling requirements of the fresh food compartment. Being under actual thermostatic control, the temperature is maintained quite efficiently at approximately the desired temperature. The temperature in the freezer compartment is not thermostatically controlled, but rather is controlled by varying the flow of refrigerated air from the evaporator chamber to the fresh food compartment, thereby forcing the compressor and evaporator to run for either longer or shorter periods of time to satisfy the requirements of the fresh food compartment, indirectly affecting the temperature in the freezer compartment.

Temperature control system of the above-described type, while inexpensive and relatively effective, have the disadvantage that the fresh food and freezer controls do not exert truly independent control over the temperatures of the two compartments. The interaction between the temperature controls contributes significantly to customer dissatisfaction and costly complaints. In actual operation, the fresh food control, in addition to desirably setting a temperature to be thermostatically maintained in the fresh food compartment, undesirably affects the temperature of the freezer compartment. This undesirable effect is a direct result of the fact that, as the setting of the fresh food control is varied, in order to satisfy the cooling requirements of the fresh food compartment as determined by the fresh food control setting, the percentage of compressor and evaporator run time also varies. For example, if the compressor runs longer to maintain the fresh food compartment at a lower desired temperature, the freezer temperature also is lowered. The freezer control actually operates as a temperature differential control to maintain the freezer compartment temperature at a given temperature below the fresh food compartment temperature, the given temperature being determined by the setting of the freezer control. If the fresh food control setting is not disturbed then the freezer control actually does control the temperature in the freezer. However, if the fresh food control setting is changed, with no change in the freezer control setting, the temperature differential between the two compartments is approximately maintained and the temperature in the freezer compartment undesirably goes up or down, depending upon the desired temperature change in the fresh food compartment.

Control interaction in the opposite direction, that is, fresh food compartment temperature variations as a result of changes in the setting of the freezer control, are not a significant problem because fresh food compartment temperature is substantially thermostatically maintained.

A further disadvantage which follows from the basic disadvantage of control interaction is that it is impossible to calibrate the freezer control directly in temperature. Any calibration of the freezer control directly in temperature would be valid only for a particular setting of the fresh food control.

Despite these disadvantages, the above-described prior art system enjoys wide use due to its relative simplicity and low cost. This points up the strick requirement that any improved system, to be practical, must also be relatively simple and low in cost.

A simple approach to the problem would be explaining to the user of the refrigerator the need to readjust the freezer control every time the setting of the fresh food control is changed. An astute user could adjust the controls to maintain the temperature he desired in both compartments. The labeling of the "fresh food control" as a "cold control" in some refrigerator models is a step in this direction. However, there are problems in such an approach. A refrigerator with controls which appear complex to operate might be more difficult to sell. In the same vein, a detailed explanation might only serve to point out to a potential customer just how much undesirable control interaction there is. Further, many users either would not fully understand an explanation or would simply choose to ignore it.

It is known to mechanically overcome the above-described interactive control problem by thermostatically adjusting the damper in the duct carrying refrigerated air from the evaporator chamber to the fresh food compartment. In such a system, employing what is termed a "thermal damper," the freezer control does not control the damper directly, but rather is connected to a thermostatic control which senses the temperature in the freezer compartment. The control adjusts the damper opening in response to both the freezer compartment temperature and the control setting to thermostatically maintain the freezer compartment temperature. Although such a system works well, it suffers the disadvantage of added complexity with attendant higher cost and greater possibility of failure in use.

Another known way to achieve truly independent temperature control for the fresh food and freezer compartment is to provide separate thermostatically controlled fans for directing refrigerated air from the evaporator chamber to each of the compartments. Each of the fans is controlled in response to a thermostatic control located in the corresponding compartment. Such a system is disclosed in U.S. Pat. No. 3,005,321-Devery. While this system also should effectively provide independent control of the temperatures in the two compartments, it too suffers the disadvantage of complexity. Further, it would require extensive changes to existing refrigerator designs to implement it.

The above-mentioned copending Webb and Hester application Ser. No. 646,167 discloses and claims a generic refrigerator temperature control system which overcomes the problem of control interaction to provide truly independent control over freezer and fresh food compartment temperature. That system conventionally includes apparatus which varies airflow through the duct as a direct function of the setting of the freezer control. Additionally, in order to compensate for undesired changes in freezer temperature which would otherwise result when the setting of the fresh food control is changed, the variable airflow apparatus has an input ganged to the fresh food control and varies airflow as an inverse function of the setting of the fresh food control.

The present invention provides specific embodiments of variable airflow apparatus which controls duct airflow as the desired function of the settings of the two control members.

SUMMARY OF THE INVENTION

A refrigerator, according to the present invention, in one embodiment thereof is an improvement of a refrigerator of the type generally comprising: a freezer compartment; a fresh food compartment; an evaporator in an evaporator chamber; and an air circulation system including a fan, passageways for circulating air from both of the compartments through the evaporator chamber, a passageway for conducting a first steam of air from the evaporator chamber to the freezer compartment, and first and second parallel ducts for conducting a second stream of air from the evaporator chamber to the fresh food compartment. The refrigerator also includes a first user-operable control member for setting a desired temperature to be maintained in the freezer compartment, designated the "freezer control," and a second user-operable control member for setting a second desired temperature to be maintained in the fresh food compartment. As is conventional, the second user-operable control member is designated the "fresh food control" and is operatively connected to a thermostatic control which includes an element for sensing fresh food compartment temperature and which controls the energization of the evaporator to approximately maintain the second preset temperature in the fresh food compartment.

In one embodiment, first and second main dampers are disposed within the first and second parallel ducts, respectively. Each of the main dampers is conventionally connected to the freezer control so as to permit decreased airflow through the ducts when the freezer control is adjusted to call for a lower temperature to be maintained in the freezer compartment and to permit increased airflow through the ducts when the freezer control is adjusted to call for a higher temperature to be maintained in the freezer compartment. In accordance with the invention, first and second compensating dampers are also disposed within the first and second parallel ducts. Each of the compensating dampers is operatively connected to the fresh food control of ganged operation with the thermostatic control in a manner which permits increased airflow through the ducts when the fresh food control is adjusted for a lower temperature to be maintained in the fresh food compartment and which permits decreased airflow through the ducts when the fresh food control is adjusted to call for a higher temperature to be maintained in the fresh food compartment. All of the dampers are constructed to only partially block airflow when in the fully closed position.

In operation, as the thermostatic fresh food compartment temperature control is manually changed to call, for example, for a higher temperature, the compressor and evaporator, as outlined in the "Background of the Invention," operate less frequently and the fresh food temperature desirably decreases. If no compensation were provided, then the temperature of the freezer compartment would also increase, undesirably. The compensation which the present invention provides through the compensating dampers ganged with the fresh food control overcomes the undesirable effect.

In another embodiment, the first compensating damper is constructed to completely block airflow when in the fully closed position and each of the other three dampers is constructed to partially block airflow when in the fully closed position. This particular embodiment is capable of being more easily adjusted to obtain a substantially ideal temperature control characteristic.

A further aspect of the present invention is a method of selecting physical characteristics of the dampers in a particular refrigerator model to achieve a substantially ideal temperature control characteristic. The method includes an adjustment step for each of the four "corners" of the ideal rectangular temperature control characteristic.

BRIEF DESCRIPTION OF THE DRAWINGS

While the novel features of the inventions are set forth with particularity in the appended claims, the invention, both as to organization and content, will be better understood and appreciated, along with other objects and features thereof, from the following detailed description taken in conjunction with the drawings, in which:

DESCRIPTION OF THE PREFERRED EMBODIMENTS

Figure 1:
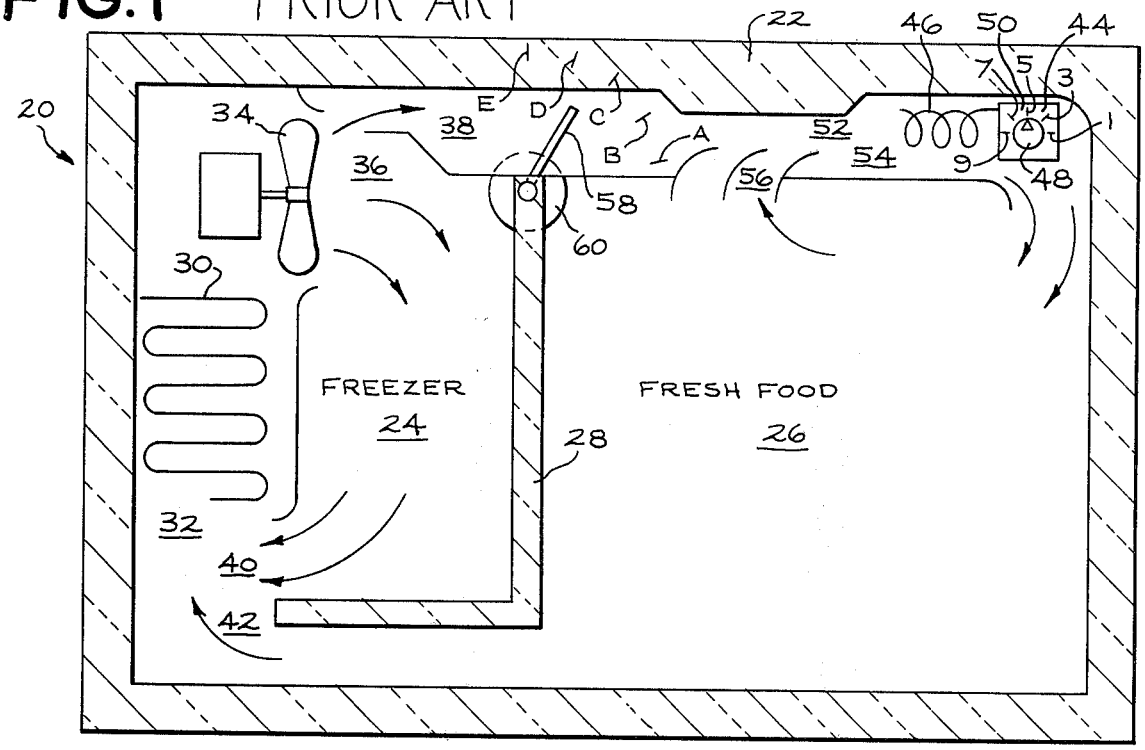
FIG. 1 PRIOR ART
FIG. 1 is a schematic representation of a refrigerator having a prior art temperature control system.

Referring first to FIG. 1, there is illustrated, in schematic form, essential elements of a prior art single evaporator, single fan combination refrigerator 20 as typified by the refrigerators disclosed in the abovementioned U.S. Pat. Nos. 3,126,717-Schumacher and 3,320,761-Gelbard. It is believed that the present invention and the operation thereof will be better understood with reference to the prior art refrigerator 20 which the invention improves. A description of the prior art refrigerator 20 therefore follows.

The refrigerator 20 generally comprises an insulated outer wall 22 defining a freezer compartment 24 and a fresh food compartment 26. The two compartments are separated by an insulated partition 28. An evaporator 30 for refrigerating the compartment 24 and 26 is contained within an evaportor chamber 32. It will be understood that the refrigerator 20 includes a conventional closed refrigerant circuit (not shown) for energizing the evaporator 30, the refrigerant circuit comprising the usual compressor, condenser, and flow restricting capillary tube. It will further be understood that a conventional radiant heater (not shown) which is periodically energized to defrost the evaporator 30 is also provided.

The refrigerator 20 also includes an air circulating system comprising a fan 34, a passageway 36 for conducting a first stream of air from the evaporator chamber 32 to the freezer compartment 24, a duct 38 for conducting a second stream of air from the evaporator chamber 32 to the fresh food compartment 26, and passageways 40 and 42 for conducting air from the two compartments back to the evaporator chamber 32. Typically, the volume of the first stream of air circulating through the freezer compartment 24 comprises approximately 90% of the total airflow through the evaporator chamber 32, with the airflow through the fresh food compartment 26 making up the remaining 10%.

In order to thermostatically maintain the desired temperature in the fresh food compartment 26, a thermostatic temperature control 44 controls the operation of the compressor (not shown), and thus energization of the evaporator 30, as needed. The thermostatic control 44 comprises a temperature sensing element such as a temperature sensing capillary 46 and an electrical switch (not shown). A first user-operable control member 48, designated the "fresh food control," is operatively connected to the thermostatic control 44. In order to reduce customer complaints which might arise if actual temperatures were indicated on the scale 50 associated with the control member 48, the scale 50 includes arbitrary graduations 1 through 9, 1 being the warmest and 9 being the coldest position.

Preferably, the refrigerated air conducted from the evaporator chamber 32 through the duct 38 into the fresh food compartment 26 is discharged through a nozzle 52 into a mixing chamber 54 so designed that a proportioned amount of fresh food compartment air is drawn through an opening 56 into the mixing chamber 54 by the aspirating effects induced by the air from the nozzle 52 and becomes mixed therewith before the temperature is sensed by the capillary 46 and before the air passes into the fresh food compartment 26. It will be apparent therefore that, rather than merely sensing the temperature of fresh food compartment air, when the fan 34 is running, the temperature sensing capillary 46 associated with thermostatic control 44 actually senses the temperature of a mixture of recirculated fresh food compartment air and refrigerated air supplied to the fresh food compartment 26 from the evaporator chamber 32. Such a system reduces the actual fresh food compartment air temperature drop needed to turn the thermostatic control 44 from "on" to "off," thereby maintaining the fresh food temperature within closer limits than would otherwise be possible. Since the temperature sensed by the capillary 46 is related to the temperature in the fresh food compartment 26, for the purposes herein, the phrase "for sensing temperature in the fresh food compartment" is intended to include such a system. Further details of the nozzle 52, the mixing chamber 54, and the operation thereof are disclosed in the above-mentioned U.S. Pat. No. 3,320,761-Gelbard.

In order to provide control over the air temperature in the freezer compartment 24, an airflow damper 58 is positioned in the duct 38 and operatively connected to a user-operable control member 60. The control member 60 is designated the "freezer control" and has graduations A through E. To obtain a colder temperature in the freezer compartment 14, the freezer control 60 is manually moved towards the E position, causing the damper 58 to further restrict airflow through the duct 38. Due to the resulting decreased refrigerated air supply to the fresh food compartment 26, the evaporator 30 is energized for a greater percentage of time to satisfy cooling requirements of the fresh fod compartment 26 to maintain the temperature thereof. Energization of the evaporator 30 occurs, of course, whenever the thermostatic control 44 causes the compressor to operate. Since the temperature within the freezer compartment 24 primarily depends upon the percentage of time and evaporator 30 is energized, the freezer temperature is lowered, as desired.

Conversely, moving the freezer control 60 towards the A position opens the damper 58 more, resulting in more refrigerated air from the evaporator chamber 32 flowing through the duct 38 into the fresh food compartment 26. This results in the evaporator being energized less often or for shorter periods of time, causing a higher freezer compartment temperature, as desired.

While only a single duct 38 and a single damper 58 are illustrated, in certain refrigerators the duct 38 is divided into two parallel ducts and a damper is included in each duct. The dampers operate together so the effect is the same.

The indications associated with the position of the freezer control 60 and the damper 58 necessarily are not calibrated in temperature because, in the prior art refrigerator 20, the actual temperature in the freezer compartment 24 is also dependent upon the setting of the fresh food control 48, as is explained in greater detail in the "Background of the Invention."

Figure 2:
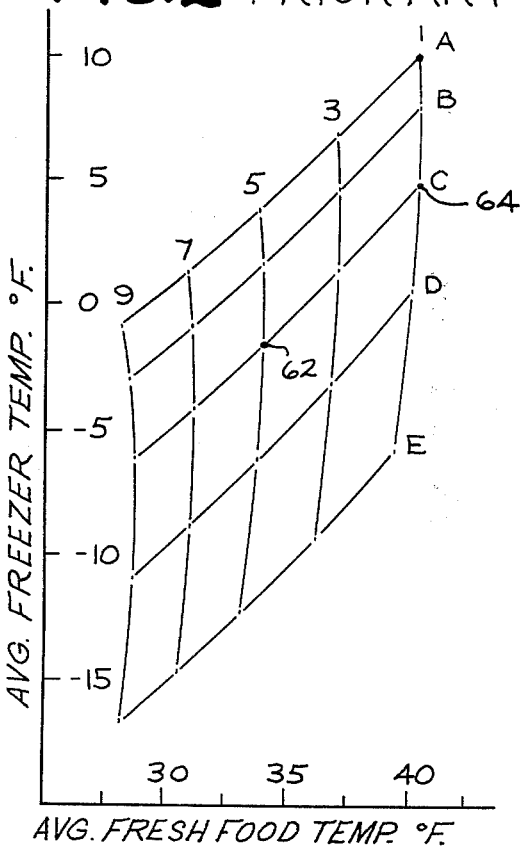
FIG. 2 PRIOR ART
FIG. 2 is a graphical illustration of the temperature control characteristic curve for the control system included in a refrigerator shown in FIG. 1.

Referring now to FIG. 2, exemplary temperature control characteristic curves for the temperature control system in the prior art refrigerator 20 described above with reference to FIG. 1 are graphically illustrated. The characteristic curves show the temperatures to be expected in both the freezer compartment 24 and the fresh food compartment 26 for various combinations of settings of the fresh food control 48 and the freezer control 60. The effects of the two controls are easily distinguished on the graph because the fresh food control 48 has numbered graduations and the freezer control 60 has lettered graduations. For example, if the fresh food control 48 is set at 5 and the freezer control is set at "C," it can be determined, from the point designated 62, that the temperature in the freezer compartment 24 is approximately −1° F and the temperature in the fresh food compartment 26 is approximately 34° F. To graphically illustrate the interaction of the fresh food temperature control 48 on the temperature in the freezer compartment 24 in the prior art system, consider an exemplary situation where the freezer control 60 remains set at C and the fresh food compartment temperature control 48 is moved from 5 to 1, calling for a warmer fresh food temperature. The resulting control point is designated 64. As desired, the temperature in the fresh food compartment 26 rises to approximately 38° F. Undesirably, the temperature in the freezer compartment 24 also rises, up from −1° F to 5° F. It will be apparent from the curves shown in FIG. 2 that the interactive effect on the fresh food control 48 on the temperature in the freezer compartment 24 is reflected on the graph by the lines which slope downwardly and to the left beginning at each of the letters A through E. Since the temperature in the fresh food compartment 26 is more nearly maintained at any desired temperature by thermostatic control action, there is very little corresponding interaction of the setting of the freezer control 60 on the temperature in the fresh food compartment 26. This is reflected on the graph by the substantially vertical lines extending downwardly from each of the numbers 1, 3, 5, 7 and 9.

Figure 3:
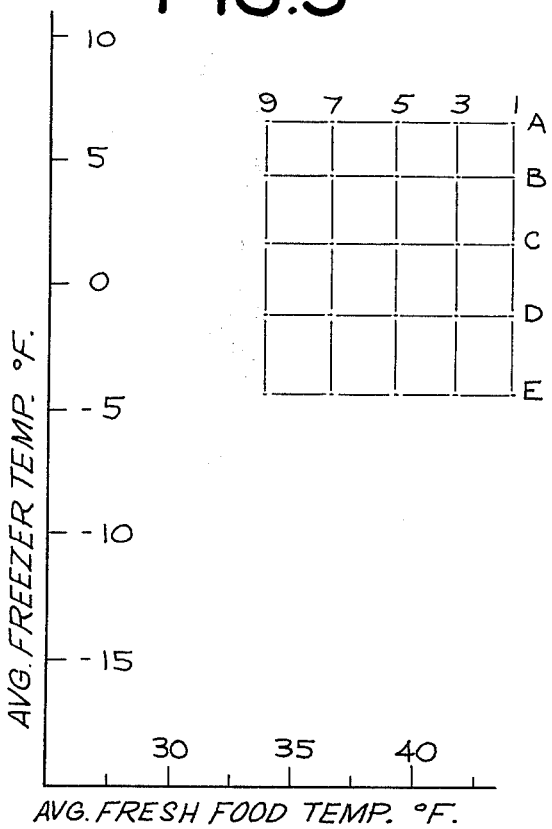
FIG. 3 is a graphical illustration of an optimum temperature control characteristic curve.

Referring to FIG. 3, desired temperature control characteristic curves are graphically illustrated. As is evident from FIG. 3, desirably the settings of the fresh food compartment control 48 (represented by numbers 1, 3, 5, 7 and 9) affect only the temperature in the fresh food compartment 26 and have no effect on the temperature in the freezer compartment 24. Apparatus according to the present invention, by proper adjustment of the preferred embodiments thereof, can achieve a temperature control characteristic similar to that of FIG. 3.

Figure 4:
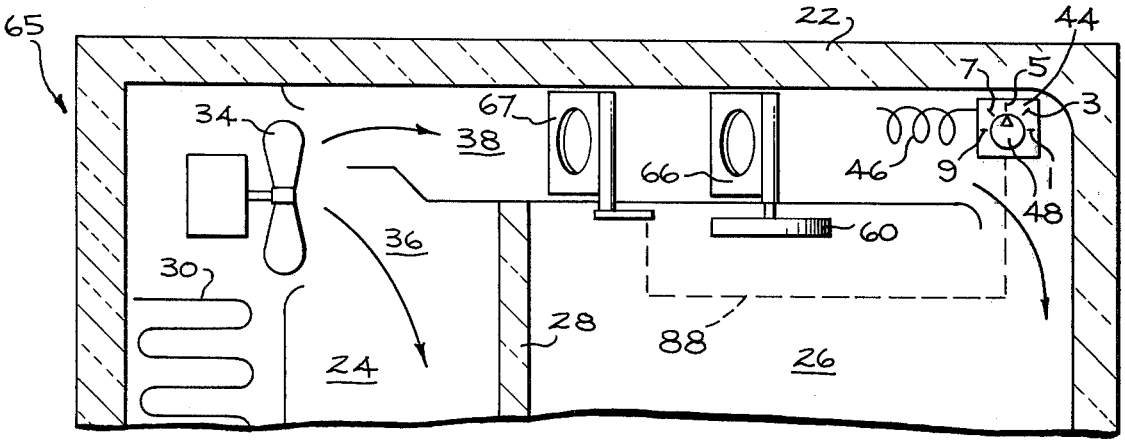
FIG. 4 is a schematic representation of a portion of a refrigerator including an embodiment of the present invention comprising a single duct with a compensating damper and a main damper in series within the single duct, each of the dampers including an opening so that airflow is only partially blocked when in the fully closed position.

Referring next to FIG. 4, there is illustrated a schematic representation of the upper portion of a refrigerator 65 constructed in accordance with the present invention. The lower portion of the refrigerator 65 is substantially identical to the prior art refrigerator 20 (FIG. 1) and is omitted for convenience of illustration. As is conventional, the freezer control 60 is connected to operate a main damper 66 disposed in the duct 38. Conventionally, as the freezer control 60 is moved toward the coldest position, the damper 66 closes more, thereby decreasing airflow through the duct 38. As the freezer control 60 is moved toward the warmest position, the damper 66 opens more, increasing airflow through the duct 38.

In order to provide compensation for changes in freezer temperature which would otherwise result when the temperature setting of the fresh food control 48 is changed, a compensating damper 67 is also disposed in the duct 38 and is connected to the fresh food control 48 for ganged operation with the thermostatic control 44. The ganged connection, shown as a broken line 88, is such that the damper 67 restricts airflow more when the fresh food control 48 is moved toward 1 or the warmest position and as the fresh food control 48 is moved toward 9 or the coldest position, the damper 67 allows more airflow through the duct 70.

The dampers 66 and 67 are constructed to only partially block airflow, even when in the fully closed position. In FIG. 4, this is accomplished by providing holes or openings in the dampers 66 and 67. Such a damper construction permits the attainment of a more desirable temperature control characteristic than would otherwise be possible. If the dampers 66 and 67 completely blocked airflow when in the fully closed position, some compensation would be achieved, but the shape of the characteristic curve would be distorted.

Figure 5:
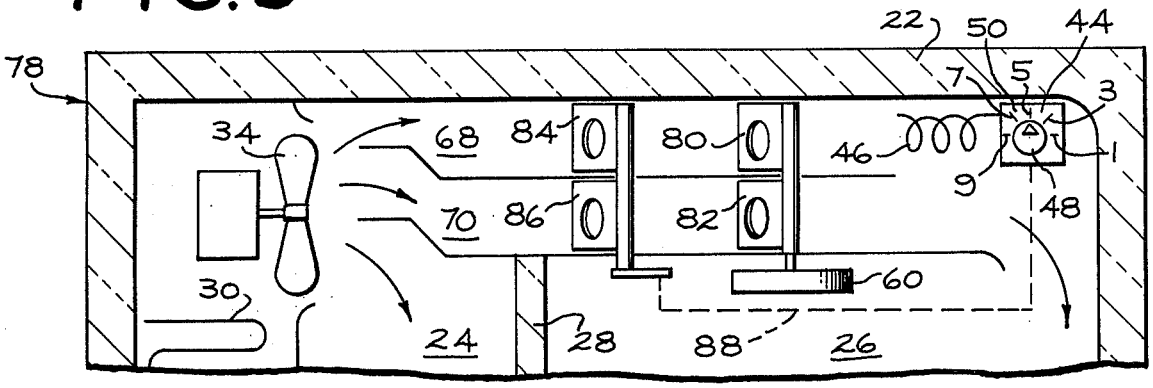
FIG. 5 s a schematic representation of a portion of a refrigerator including an embodiment of the present invention comprising two parallel ducts with compensating dampers and main dampers disposed in each of the parallel ducts.

Referring now to FIG. 5, there is shown a schematic representation of a refrigerator 78 which is similar to the representation of the refrigerator 65 (FIG. 4), but which has a parallel duct configuration. In the refrigerator 78, instead of a single duct 38 for conducting refrigerated air from the evaporator chamber 32 to the fresh food compartment 26, there are first and second parallel ducts 68 and 70. The ducts 68 and 70 combine in a Y junction back into a single duct before discharging into the fresh food compartment 26. First and second main dampers 80 and 82 are disposed within the first and second parallel ducts 68 and 70. Each of the main dampers 80 and 82 is operatively connected to the freezer control 60 so as to permit decreased airflow through the ducts 68 and 70 when the freezer control is adjusted to call for a lower temperature to be maintained in the freezer compartment 24 and to permit increased airflow through the ducts 68 and 70 when the freezer control 60 is adjusted to call for a higher temperature to be maintained in the freezer compartment 24.

In order to provide compensation, first and second compensating dampers 84 and 86 are disposed within the ducts 68 and 70, respectively. Each of the compensating dampers 84 and 86 is operatively connected to the fresh food control 48 for ganged operation with the thermostatic control 44. The ganged connection 88 is such that increased airflow through the ducts 68 and 70 is permitted when the fresh food control 48 is adjusted to call for a lower temperature to be maintained in the fresh food compartment 26 and decreased airflow through the ducts 68 and 70 is permitted when the fresh food control 48 is adjusted to call for a higher temperature to be maintained in the fresh food compartment 26.

It will be apparent that, since the first and second main dampers 80 and 82 are similar and operate together and since the first and second compensating dampers 84 and 86 are similar and operate together, that the effect of the configuration of FIG. 5 is the same as the configuration of FIG. 4.

In the operation of the embodiments shown in FIGS. 4 and 5, as the fresh food control 48 is manually changed to call, for example, for a higher temperature, the compressor and evaporator 30, under control of the thermostatic control 44, operate less frequently. Desirably, temperature in the fresh food compartment 26 increases. If no compensation were provided, then, undesirably, temperature in the freezer compartment 24 would also increase. The compensation provided through the ganged connection 88 causes the flow of refrigerated air from the evaporator chamber 32 to the fresh food compartment 26 to be further restricted, just as if the freezer control 60 had been manually adjusted to call for a lower freezer temperature. The compensation causes the freezer temperature to remain more constant than if no compensation were provided. Conversely, as the fresh food control 48 is manually changed to call, for example, for a lower temperature, the evaporator 30 operates more frequently and the fresh food temperature desirably decreases. In order to compensate for the undesired decrease in freezer temperature which would otherwise result, the flow of refrigerated air from the evaporator chamber 32 to the fresh food compartment 26 is caused to increase.

Figure 6:
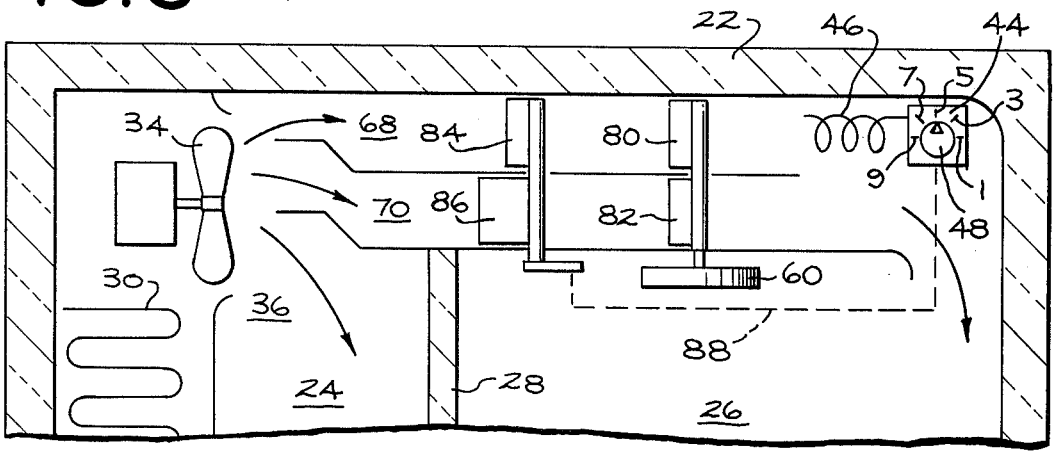
FIG. 6 is a view similar to FIG. 5, showing an embodiment in which one of the compensating dampers completely blocks airflow when in the fully closed position but the other three dampers are shortened to only partially block airflow when in the fully closed position.
Figure 7:
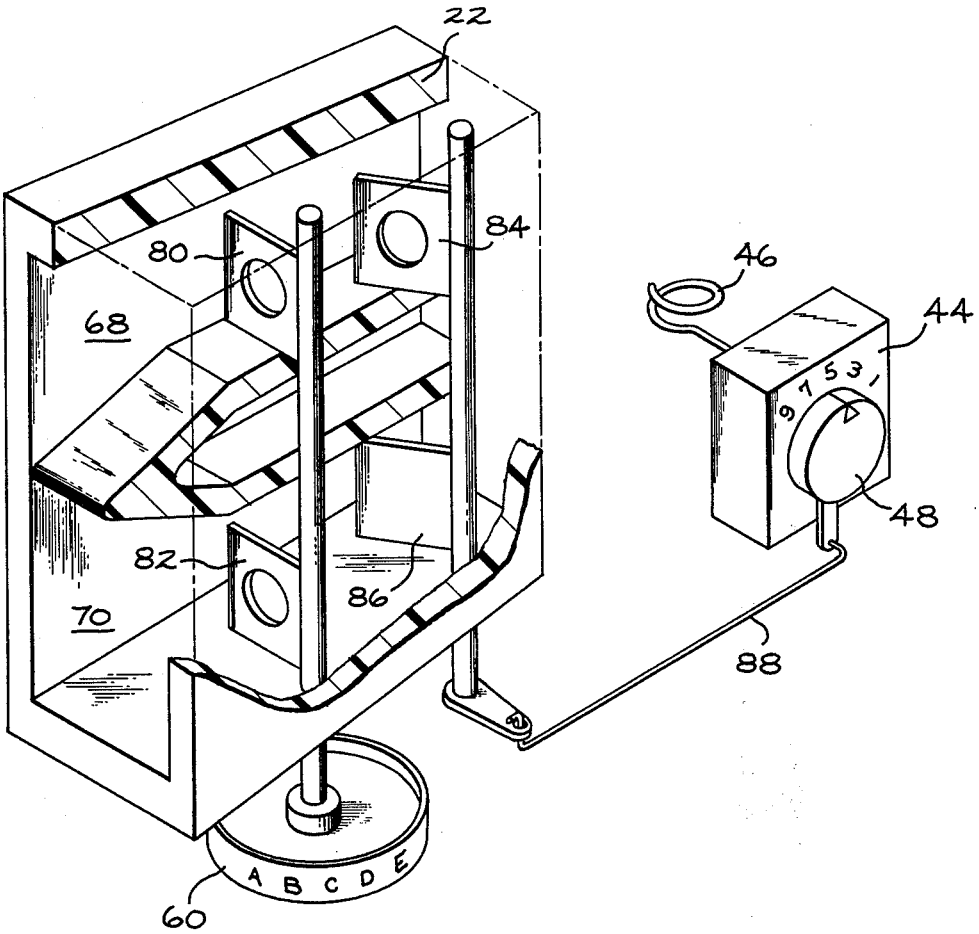
FIG. 7 is a perspective view of airflow control apparatus, similar to FIG. 6, except that openings through the dampers, rather than shortening of the dampers, enable the dampers to only partially block airflow when in the fully closed position.

Referring now to FIGS. 6 and 7, there are shown two embodiments, essentially identical in operation, which are capable of achieving a substantially ideal temperature control characteristic such as is illustrated in FIG. 3, and which further are capable of being readily adjusted to obtain such a characteristic.

In FIGS. 6 and 7, the damper configuration varies from the configuration of FIG. 5 in that the second compensating damper 86 is constructed to completely block airflow when in the fully closed position. The other dampers 80, 82, and 84 are constructed to only partially block airflow when in the fully closed position. In FIG. 6, this is accomplished by shortening the dampers so that they do not extend completely across the width of the ducts. In FIG. 7, the dampers are constructed with holes, or openings, so that airflow passes through the openings when the dampers are in the closed position.

The operation of the embodiments shown in FIGS. 6 and 7 is substantially as described with the reference to the embodiments shown in FIGS. 4 and 5, and is not repeated.

It is not essential to the achieving of a desirable temperature control characteristic the the second compensating damper 86 be constructed to completely block airflow when in the fully closed position, but it does aid in adjustment. Selection of damper sizes for the embodiments shown in FIG. 6 and 7 may be performed by experimenting with different degrees of shortening of the dampers, in the case of the embodiment shown in FIG. 6, or with different size openings, in the case of the embodiment shown in FIG. 7. The necessary design adjustment to achieve a desirable degree of compensation will vary with different refrigerator models, but once determined for a particular model, will remain substantially constant for each production copy manufactured. Such design adjustment is well within the skill of one skilled in the art once the compensating dampers 84 and 86 and the linkage 88 to the fresh food control 48 are included in the refrigerator.

Figure 8:
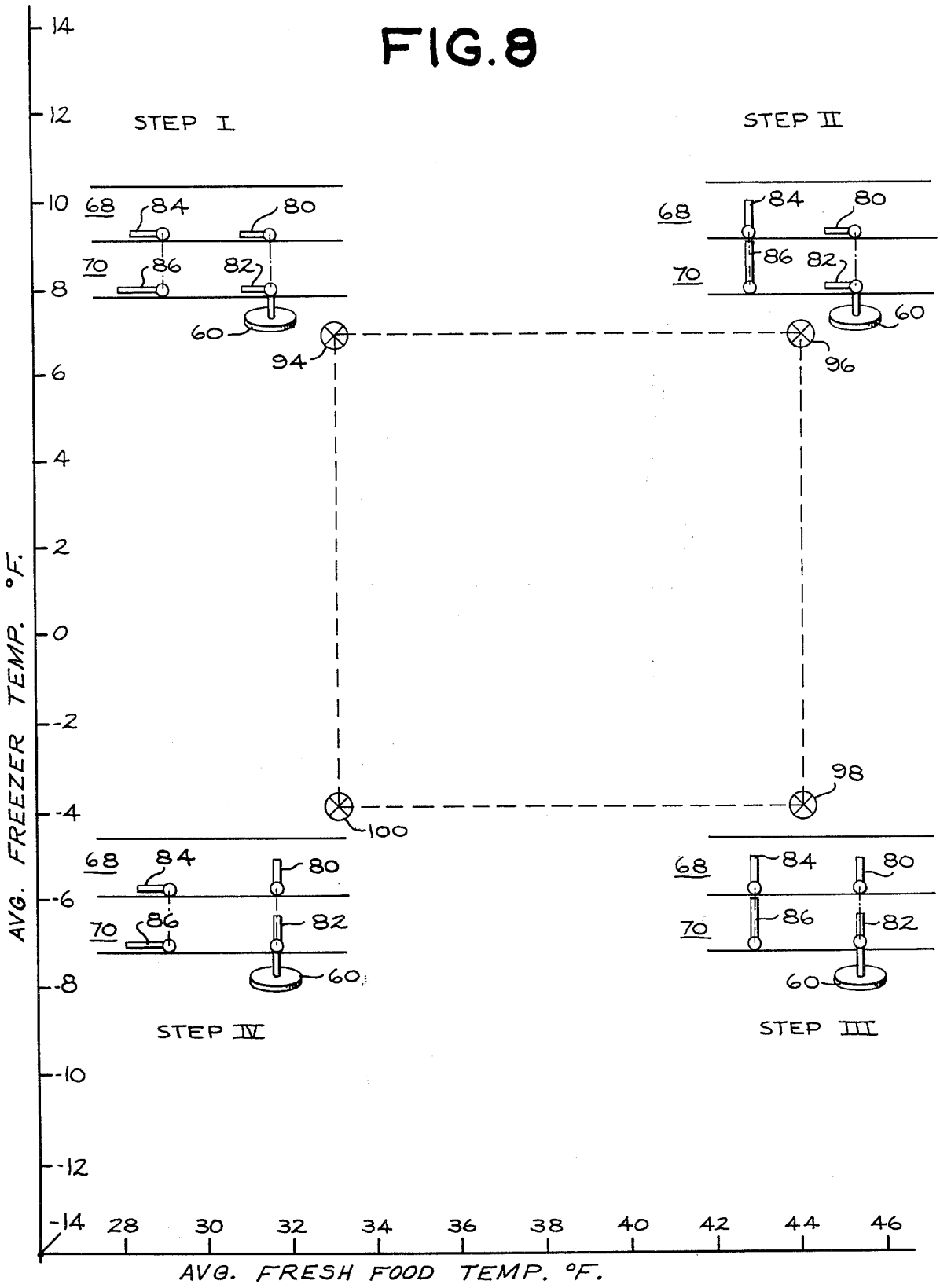
FIG. 8 graphically illustrates a method of adjustment to obtain temperature control points at each of the four corners of an optimum temperature control characteristic curve.

Referring now to FIG. 8, for the purpose of illustrating a design adjustment procedure, there are shown the outer boundaries of a set of desirable characteristic curves such as those illustrated in FIG. 3, together with simplified schematic representations of the first and second parallel ducts 68 and 70 and the dampers 80, 82, 84, and 86 adjacent each of the four "corners" of the curve boundary. It will be understood that, while the damper configuration of FIG. 6 in which partial air restriction when in the fully closed position is achieved by shortening the dampers is shown, FIG. 8 applies equally as well to dampers such as are shown in FIG. 7 where partial air restriction when in the fully closed position is achieved through the use of openings in the dampers.

In the method of adjustment, the first step obtains a first control point 94 which represents the warmest freezer and the coldest fresh food temperatures to be set. The thermostatic fresh food control 48 is set to the coldest position and all dampers are placed in the fully open position. The total duct size in the air circulation system of the refrigerator and the fan baffling are adjusted to obtain the desired freezer temperature.

The second step obtains a second control point 96 which represents the warmest freezer and the warmest fresh food temperatures to be set. The thermostatic fresh food control 48 is set to warmest position and both compensating dampers 84 and 86 are placed in the fully closed position. Both main dampers 80 and 82 remain in the fully open position. As a result, there is no airflow through the second parallel duct 70 and airflow through the first parallel duct 68 depends upon leakage past the first compensating damper 84. The degree of blockage of the first compensating damper 84 is adjusted to obtain the desired freezer temperature.

In the third step, a third control point 98 is obtained which represents the coldest freezer and the warmest fresh food temperatures to be set. The thermostatic fresh food control 48 is left in the warmest position and all dampers are placed in the fully closed position. The degree of blockage of the first main damper 80 is adjusted to obtain the desired freezer temperature.

To obtain a fourth control point 100 which represents the coldest freezer and the coldest fresh food temperatures to be set, the thermostatic fresh food control 48 is again set to the coldest position and both compensating dampers 84 and 86 are placed in the fully open position with the main dampers 80 and 82 remaining in the fully closed position. The degree of blockage of the second main damper 82 is adjusted to obtain the desired freezer temperature.

The preceding method of adjustment will result in a substantially square compensating characteristic with a minimum effort. It will be understood that, in following the method, at each step the freezer temperature will vary with the blockage adjustment, but that the fresh food temperature will remain substantially constant due to thermostatic control.

It will be apparent that the present invention provides a single evaporator, single fan combination refrigerator which has substantially independent fresh food and freezer temperature controls. Certain embodiments are easier to adjust and a method of adjustment therefor has been provided.

While spedific embodiments of the invention have been illustrated and described herein, it is realized that numerous modifications and changes will occur to those skilled in the art. It is therefore to be understood that the appended claims are intended to cover all such modifications and changes as fall within the true spirit and scope of the invention.

What is claimed is:

1. A refrigerator comprising:

a. a freezer compartment;

b. a fresh food compartment;

c. an evaporator chamber and an evaporator in said chamber;

d. an air circulation system including a fan and passageways for circulating air from both of said compartments through said evaporator chamber, a passageway for conducting a first steam of air from said evaporator chamber to said freezer compartment, and a first duct for conducting a second stream of air from said evaporator chamber to said fresh food compartment;

e. a thermostatic control for maintaining a desired temperature in said fresh food compartment by causing energization of said evaporator as required, said thermostatic control including an element for sensing temperature in said fresh food compartment;

f. a first user-operable control member for setting a desired temperature to be maintained in said freezer compartment;

g. a second user-operable control member for setting the desired temperature to be maintained in said fresh food compartment, said second user-operable control member being operatively connected to said thermostatic control;

h. a first main damper disposed within said first duct, said main damper being constructed to only partially block airflow when in the fully closed position and operatively connected to said first user-operable control member so as to permit decreased airflow through said first duct when said first user-operable control member is adjusted to call for a lower temperature to be maintained in said freezer compartment and to permit increased airflow through said first duct when said first user-operable control member is adjusted to call for a higher temperature to be maintained in said freezer compartment; and i. a first compensating damper disposed within said first duct, said compensating damper being constructed to only partially block airflow when in the fully closed position and operatively connected to said second user-operable control member for ganged operation with said thermostatic control so as to permit increased airflow through said first duct when said second user-operable control member is adjusted to call for a lower temperature to be maintained in said fresh food compartment and to permit decreased airflow through said first duct when said second user-operable control member is adjusted to call for a higher temperature to be maintained in said fresh food compartment, the airflow through said first duct into said fresh food compartment thereby being a function of the settings of both of said user-operable control members, said function being selected so that the desired temperature is approximately maintained in said freezer compartment even though the setting of said second user-operable control member is changed.

2. A refrigerator according to claim 1, further comprising:

a. a second duct for conducting the second stream of air from said evaporator chamber to said fresh food compartment, said second duct being connected in parallel with said first duct;

b. a second main damper disposed within said second duct, said second main damper being constructed to only partially block airflow when in the fully closed position and operatively connected to said first user-operable control member so as to permit decreased airflow through said second duct when said first user-operable control member is adjusted to call for a lower temperature to be maintained in said freezer compartment and to permit increased airflow through said second duct when said first user-operable control member is adjusted to call for a higher temperature to be maintained in said freezer compartment; and c. a second compensating damper disposed within said second duct, said second compensating damper being constructed to only partially block airflow when in the fully closed position and operatively connected to said second user-operable control member for ganged operation with said thermostatic control so as to permit increased airflow through said second duct when said second user-operable control member is adjusted to call for a lower temperature to be maintained in said fresh food compartment and to permit decreased airflow through said second duct when said second user-operable control member is adjusted to call for a higher temperature to be maintained in said fresh food compartment.

3. A refrigerator according to claim 1, further comprising:

a. a second duct for conducting the second stream of air from said evaporator chamber to said fresh food compartment, said second duct being connected in parallel with said first duct;

b. a second main damper disposed within said second duct, said second main damper being constructed to only partially block airflow when in the fully closed position and operatively connected to said first user-operable control member so as to permit decreased airflow through said second duct when said first user-operable control member is adjusted to call for a lower temperature to be maintained in said freezer compartment and to permit increased airflow through said second duct when said first user-operable control member is adjusted to call for a higher temperature to be maintained in said freezer compartment; and c. a second compensating damper disposed within said second duct, said second compensating damper being constructed to substantially fully block airflow when in the fully closed position and operatively connected to said second user-operable control member for ganged operation with said thermostatic control so as to permit increased airflow through said second duct when said second user-operable control member is adjusted to call for a lower temperature to be maintained in said fresh food compartment and to permit decreased airflow through said second duct when said second user-operable control member is adjusted to call for a higher temperature to be maintained in said fresh food compartment.

* * * * *

UNITED STATES PATENT AND TRADEMARK OFFICE

CERTIFICATE OF CORRECTION

PATENT NO. : 4,009,589

DATED : March 1, 1977

INVENTOR(S) : WILLIAM M. WEBB and STEPHEN G. BOUGHTON

It is certified that error appears in the above-identified patent and that said Letters Patent are hereby corrected as shown below:

Column 2, line 22, "decreases" should read -- increases --.

Column 5, line 4, "decreases" should read -- increases --.

Column 11, line 61, "steam" should read -- stream --.

Signed and Sealed this

***Twenty-third* Day of *May 1978***

[SEAL]

*Attest:*

RUTH C. MASON
*Attesting Officer*

LUTRELLE F. PARKER
*Acting Commissioner of Patents and Trademarks*